US008233353B2

(12) United States Patent
Zhang et al.

(10) Patent No.: US 8,233,353 B2
(45) Date of Patent: Jul. 31, 2012

(54) MULTI-SENSOR SOUND SOURCE LOCALIZATION

(75) Inventors: Cha Zhang, Sammamish, WA (US); Dinei Florencio, Redmond, WA (US); Zhengyou Zhang, Bellevue, WA (US)

(73) Assignee: Microsoft Corporation, Redmond, WA (US)

( * ) Notice: Subject to any disclaimer, the term of this patent is extended or adjusted under 35 U.S.C. 154(b) by 1260 days.

(21) Appl. No.: 11/627,799

(22) Filed: Jan. 26, 2007

(65) Prior Publication Data

US 2008/0181430 A1 Jul. 31, 2008

(51) Int. Cl.
*H04S 7/00* (2006.01)
*H04R 1/20* (2006.01)

(52) U.S. Cl. ..... 367/129; 367/124; 381/92

(58) Field of Classification Search ..... 367/124, 367/127, 129

See application file for complete search history.

(56) References Cited

U.S. PATENT DOCUMENTS

| | | | | |
|---|---|---|---|---|
| 6,999,593 | B2 * | 2/2006 | Rui et al. | 381/92 |
| 7,254,241 | B2 * | 8/2007 | Rui et al. | 381/92 |
| 7,343,289 | B2 * | 3/2008 | Cutler et al. | 704/259 |
| 7,349,005 | B2 * | 3/2008 | Rui et al. | 348/14.11 |
| 2004/0037436 | A1 * | 2/2004 | Rui | 381/92 |

OTHER PUBLICATIONS

Allen, J. B., and D. A. Berkley, Image method for efficiently simulating small-room acoustics, JASA, vol. 65, pp. 943-950, 1979.

Basu, S., B. Clarckson, and A. Pentland, Smart headphones: Enhancing auditory awareness through robust speech detection and source localization, *Proc. of IEEE ICASSP*, 2001.

Brandstein, M., and H. Silverman, A Practical methodology for speech localization with microphone array, Tech. Rep., Brown University, 1996.

Brandstein, M., and H. Silverman, A robust method for speech signal time-delay estimation on reverberant rooms, *Proc. of ICASSP*, 1997.

Coen, M., Design principles for intelligent environments, *Proc. National Conf. of Artificial Intelligence*, 1998.

Cox, H. R. M. Zeskind, and M. M. Owen, Robust adaptive beamforming, *IEEE Trans. on Acoustics, Speech and Signal Processing*, vol. ASSP-35, No. 10, pp. 1365-1376, 1987.

Cutler, R., Y. Rui, A. Gupta, J. Cadiz, I. Tashev, L.W. He, A. Colburn, Z. Zhang, Z. Liu, and S. Silverbert, Distributed meetings: A meeting capture and broadcasting system, *Proc. ACM Conf. on Multimedia*, 2002.

Georgiou, P., C. Kyriakakis, and P. Tsakalides, Robust time delay estimation for sound source localization in noisy environments, *Proc. of WASPAA*, 1997.

Gustafsson, T., B. Rao, and M. Trivedi, Source localization in reverberant environments: Performance bounds and ml estimation, *Proc. of ICASSP*, 2001.

(Continued)

*Primary Examiner* — Ian Lobo

(74) *Attorney, Agent, or Firm* — Lyon & Harr, LLP; Richard T. Lyon

(57) ABSTRACT

A multi-sensor sound source localization (SSL) technique is presented which provides a true maximum likelihood (ML) treatment for microphone arrays having more than one pair of audio sensors. Generally, this is accomplished by selecting a sound source location that results in a time of propagation from the sound source to the audio sensors of the array, which maximizes a likelihood of simultaneously producing audio sensor output signals inputted from all the sensors in the array. The likelihood includes a unique term that estimates an unknown audio sensor response to the source signal for each of the sensors in the array.

20 Claims, 6 Drawing Sheets

OTHER PUBLICATIONS

Harmanci, K., J. Tabrikian, and J. L. Krolik, Relationships between adaptive minimum variance beamforming and optimal source localization, *IEEE Trans. on Signal Processing*, vol. 40, No. 1, pp. 1-12, 2000.

Kleban, J., Combined acoustic and visual processing for video conferencing systems, *Tech. Rep.*, The State University of New Jersey, Rutgers, 2000.

Knapp, C., and G. Carter, The generalized correlation method for estimation of time delay, *IEEE Trans. on Acoustics, Speech and Signal Processing*, vol. ASSP-24, No. 4, pp. 320-327, 1976.

Li, D., and S. Levinson, Adaptive sound source localization by two microphones, *Proc. of Int. Conf. on Robotics and Automation*, 2002.

Mungamuru, B., and P. Aarabi, Enhanced sound localization, *IEEE Trans. on Systems, Man and Cybernetics—Part B: Cybernetics*, vol. 34, No. 13, pp. 1526-1540, 2004.

Rui, Y., and D. Florêncio, Time delay estimation in the presence of correlated noise and reverberation, *Proc. of ICASSP*, 2005.

Rui, Y., D. Florêncio, W. Lam, and J. Su, Sound source localization for circular arrays of directional microphones, *Proc. of ICASSP*, 2005.

Sheng, X. and Y.-H. Hu, Maximum likelihood multiple-source localization using acoustic energy measurements with wireless sensor networks, *IEEE Trans. on Signal Processing*, vol. 53, No. 1, pp. 44-53, 2005.

Wahlster, W., N. Reithinger and A. Blocher, Smartkom: Multimodal communication with a life-like character, *Proc. Eurospeech*, 2001.

Wang, H., and P. Chu, Voice source localization for automatic camera pointing system in videoconferencing, *Proc. of IEEE ICASSP*, 1997.

Weng, J., and K. Y. Guentchev, Three-dimensional sound localization from a compact non-coplanar array of microphones using tree-based learning, *The Journal of Acoustical Society of America*, vol. 110, No. 1, pp. 310-323, 2001.

Ziskind, I., and M. Wax, Maximum likelihood localization of multiple sources by alternating projection, *IEEE Trans. Acoustics, Speech and Signal Processing*, vol. 36, No. 10, pp. 1553-1560, 1988.

* cited by examiner

MULTI-SENSOR SOUND SOURCE LOCALIZATION

BACKGROUND

Sound source localization (SSL) using microphone arrays is employed in many important applications such as human-computer interaction and intelligent rooms. A large number of SSL algorithms have been proposed, with varying degrees of accuracy and computational complexity. For example, in broadband acoustic source localization applications such as teleconferencing, a number of SSL techniques are popular. These include steered-beamformer (SB), high-resolution spectral estimation, time delay of arrival (TDOA), and learning based techniques.

In regard to the TDOA approach, most existing algorithms take each pair of audio sensors in the microphone array and compute their cross-correlation function. In order to compensate for reverberation and noise in the environment a weighting function is often employed in front of the correlation. A number of weighting functions have been tried. Among them is the maximum likelihood (ML) weighting function.

However, these existing TDOA algorithms are designed to find the optimal weight for pairs of audio sensors. When more than one pair of sensors exists in the microphone array an assumption is made that pairs of sensors are independent and their likelihood can be multiplied together. This approach is questionable as the sensor pairs are typically not truly independent. Thus, these existing TDOA algorithms do not represent true ML algorithms for microphone arrays having more than one pair of audio sensors.

SUMMARY

The present multi-sensor sound source localization (SSL) technique provides a true maximum likelihood (ML) treatment for microphone arrays having more than one pair of audio sensors. This technique estimates the location of a sound source using signals output by each audio sensor of a microphone array placed so as to pick up sound emanating from the source in an environment exhibiting reverberation and environmental noise. Generally, this is accomplished by selecting a sound source location that results in a time of propagation from the sound source to the audio sensors of the array, which maximizes a likelihood of simultaneously producing audio sensor output signals inputted from all the sensors in the array. The likelihood includes a unique term that estimates an unknown audio sensor response to the source signal for each of the sensors.

It is noted that while the foregoing limitations in existing SSL techniques described in the Background section can be resolved by a particular implementation of an multi-sensor SSL technique according to the present invention, this is in no way limited to implementations that just solve any or all of the noted disadvantages. Rather, the present technique has a much wider application as will become evident from the descriptions to follow.

It should also be noted that this Summary is provided to introduce a selection of concepts, in a simplified form, that are further described below in the Detailed Description. This Summary is not intended to identify key features or essential features of the claimed subject matter, nor is it intended to be used as an aid in determining the scope of the claimed subject matter. In addition to the just described benefits, other advantages of the present invention will become apparent from the detailed description which follows hereinafter when taken in conjunction with the drawing figures which accompany it.

DESCRIPTION OF THE DRAWINGS

The specific features, aspects, and advantages of the present invention will become better understood with regard to the following description, appended claims, and accompanying drawings where:

DETAILED DESCRIPTION

In the following description of embodiments of the present invention reference is made to the accompanying drawings which form a part hereof, and in which are shown, by way of illustration, specific embodiments in which the invention may be practiced. It is understood that other embodiments may be utilized and structural changes may be made without departing from the scope of the present invention.

1.0 The Computing Environment

Before providing a description of embodiments of the present multi-sensor SSL technique, a brief, general description of a suitable computing environment in which portions thereof may be implemented will be described. The present multi-sensor SSL technique is operational with numerous general purpose or special purpose computing system environments or configurations. Examples of well known computing systems, environments, and/or configurations that may be suitable include, but are not limited to, personal computers, server computers, hand-held or laptop devices, multiprocessor systems, microprocessor-based systems, set top boxes, programmable consumer electronics, network PCs, minicomputers, mainframe computers, distributed computing environments that include any of the above systems or devices, and the like.

Figure 1:
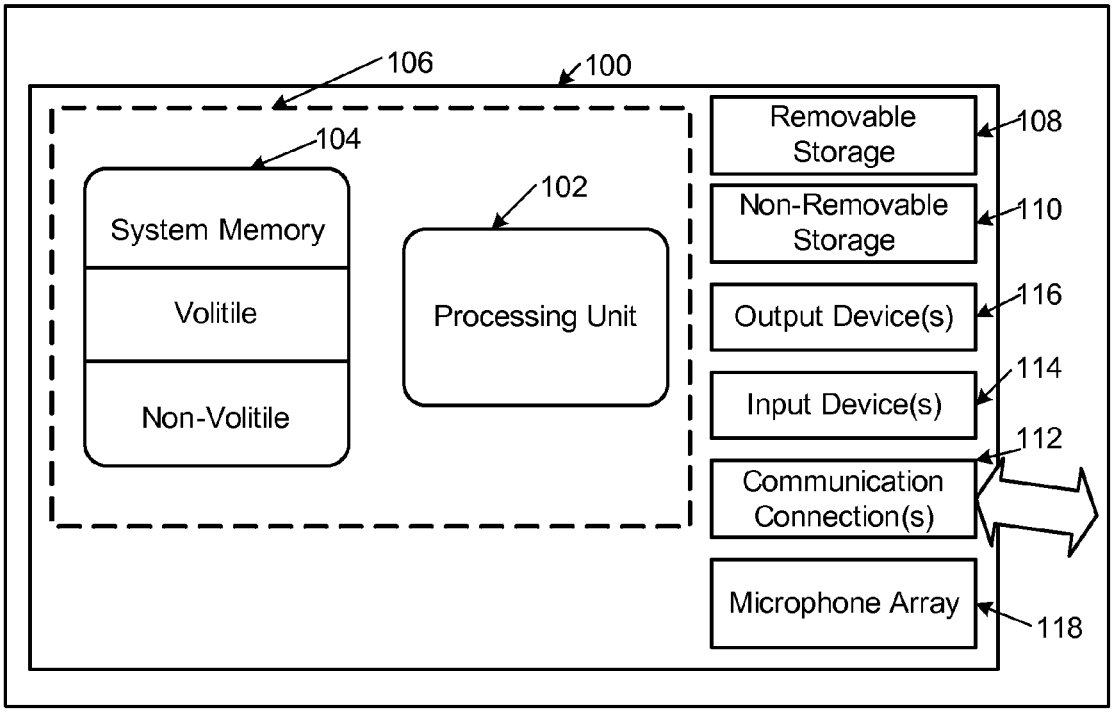
FIG. 1 is a diagram depicting a general purpose computing device constituting an exemplary system for implementing the present invention.

FIG. 1 illustrates an example of a suitable computing system environment. The computing system environment is only one example of a suitable computing environment and is not intended to suggest any limitation as to the scope of use or functionality of the present multi-sensor SSL technique. Neither should the computing environment be interpreted as having any dependency or requirement relating to any one or combination of components illustrated in the exemplary operating environment. With reference to FIG. 1, an exemplary system for implementing the present multi-sensor SSL technique includes a computing device, such as computing device 100. In its most basic configuration, computing device 100 typically includes at least one processing unit 102 and memory 104. Depending on the exact configuration and type of computing device, memory 104 may be volatile (such as RAM), non-volatile (such as ROM, flash memory, etc.) or some combination of the two. This most basic configuration is illustrated in FIG. 1 by dashed line 106. Additionally, device 100 may also have additional features/functionality. For example, device 100 may also include additional storage (removable and/or non-removable) including, but not limited to, magnetic or optical disks or tape. Such additional storage is illustrated in FIG. 1 by removable storage 108 and non-removable storage 110. Computer storage media includes volatile and nonvolatile, removable and non-removable media implemented in any method or technology for storage of information such as computer readable instructions, data structures, program modules or other data. Memory 104, removable storage 108 and non-removable storage 110 are all examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can accessed by device 100. Any such computer storage media may be part of device 100.

Device 100 may also contain communications connection(s) 112 that allow the device to communicate with other devices. Communications connection(s) 112 is an example of communication media. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. The term computer readable media as used herein includes both storage media and communication media.

Device 100 may also have input device(s) 114 such as keyboard, mouse, pen, voice input device, touch input device, camera, etc. Output device(s) 116 such as a display, speakers, printer, etc. may also be included. All these devices are well know in the art and need not be discussed at length here.

Of particular note is that device 100 includes a microphone array 118 having multiple audio sensors, each of which is capable of capturing sound and producing an output signal representative of the captured sound. The audio sensor output signals are input into the device 100 via an appropriate interface (not shown). However, it is noted that audio data can also be input into the device 100 from any computer-readable media as well, without requiring the use of a microphone array.

The present multi-sensor SSL technique may be described in the general context of computer-executable instructions, such as program modules, being executed by a computing device. Generally, program modules include routines, programs, objects, components, data structures, etc. that perform particular tasks or implement particular abstract data types. The present multi-sensor SSL technique may also be practiced in distributed computing environments where tasks are performed by remote processing devices that are linked through a communications network. In a distributed computing environment, program modules may be located in both local and remote computer storage media including memory storage devices.

The exemplary operating environment having now been discussed, the remaining parts of this description section will be devoted to a description of the program modules embodying the present multi-sensor SSL technique.

2.0 Multi-Sensor Sound Source Localization (SSL)

Figure 2:
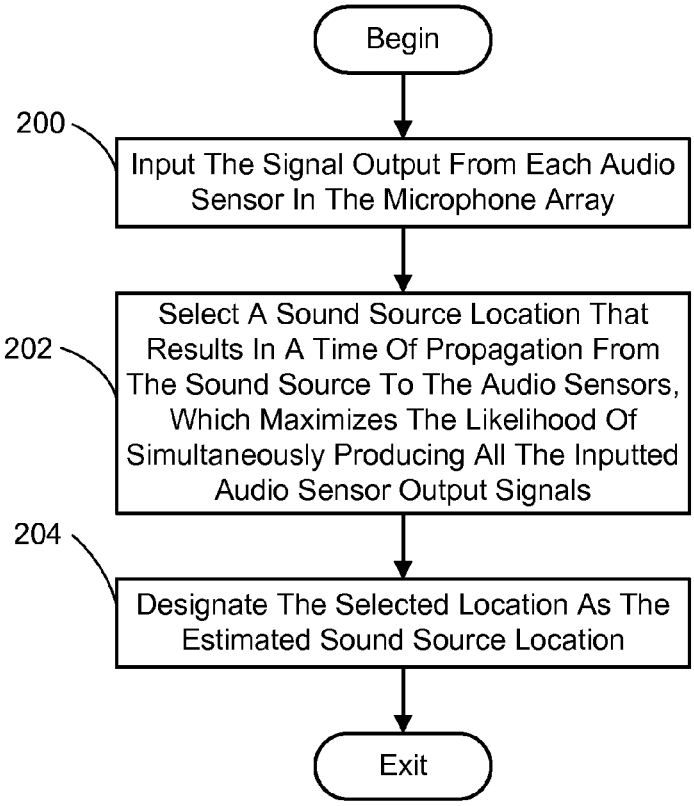
FIG. 2 is a flow diagram generally outlining a technique for estimating the location of a sound source using signals output by a microphone array.

The present multi-sensor sound source localization (SSL) technique estimates the location of a sound source using signals output by a microphone array having multiple audio sensors placed so as to pick up sound emanating from the source in an environment exhibiting reverberation and environmental noise. Referring to FIG. 2, in general the present technique involves first inputting the output signal from each audio sensor in the array (200). Then a sound source location is selected that would result in a time of propagation from the sound source to the audio sensors, which maximizes the likelihood of simultaneously producing all the inputted audio sensor output signals (202). The selected location is then designated as the estimated sound source location (204).

The present technique and in particular how the aforementioned sound source location is selected will be described in more detail in the sections to follow, starting with a mathematical description of the existing approaches.

2.1 Existing Approaches

Consider an array of P audio sensors. Given a source signal s(t), the signals received at these sensors can be modeled as:

$$x_i(t)=\alpha_i s(t-\tau_i)+h_i(t)\otimes s(t)+n_i(t), \tag{1}$$

where i=1, . . . , P is the index of the sensors; $\tau_i$ is the time of propagation from the source location to the $i^{th}$ sensor location; $\alpha_i$ is an audio sensor response factor that includes the propagation energy decay of the signal, the gain of the corresponding sensor, the directionality of the source and the sensor, and other factors; $n_i(t)$ is the noise sensed by the $i^{th}$ sensor; $h_i(t)\otimes s(t)$ represents the convolution between the environmental response function and the source signal, often referred as the reverberation. It is usually more efficient to work in the frequency domain, where the above model can be rewritten as:

$$X_i(\omega)=\alpha_i(\omega)S(\omega)e^{-j\omega\tau_i}+H_i(\omega)S(\omega)+N_i(\omega), \tag{2}$$

Figure 3:
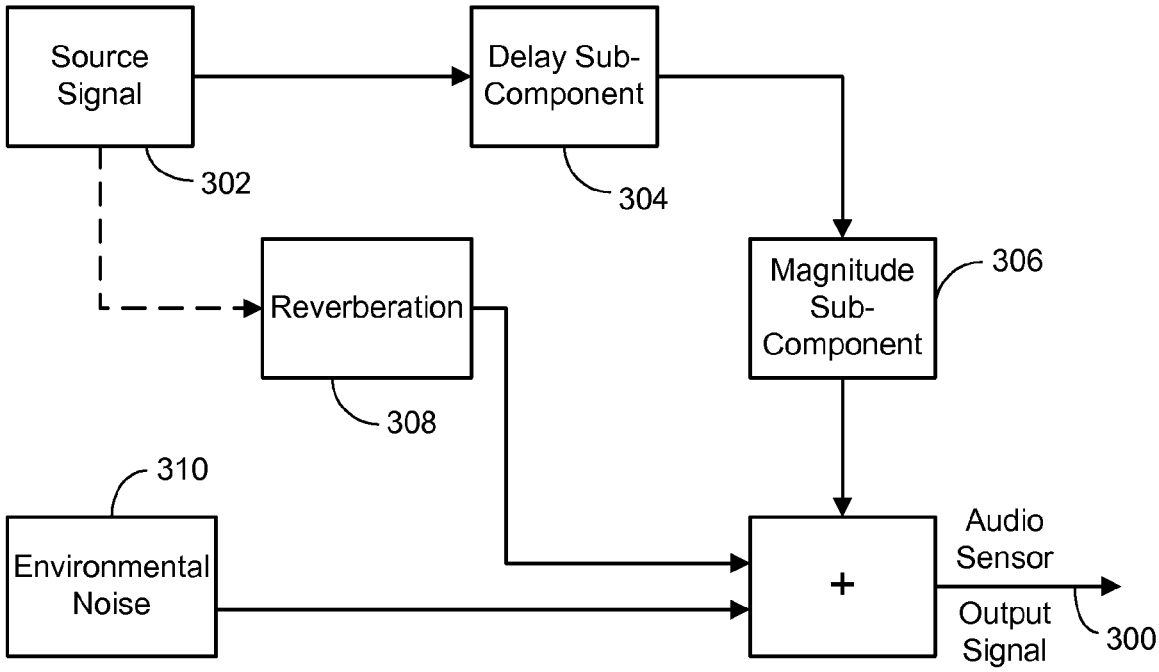
FIG. 3 is a block diagram illustrating a characterization of the signal components making up the output of an audio sensor of the microphone array.

Thus, as shown in FIG. 3, for each sensor in the array, the output X(ω) 300 of the sensor can be characterized as a combination of the sound source signal S(ω) 302 produced by the audio sensor in response to sound emanating from the sound source as modified by the sensor response which includes a delay sub-component $e^{-j\omega\tau}$ 304 and a magnitude sub-component α(ω) 306, a reverberation noise signal H(ω) 308 produced by the audio sensor in response to the reverberation of the sound emanating from the sound source, and the environmental noise signal N(ω) 310 produced by the audio sensor in response to environmental noise.

The most straightforward SSL technique is to take each pair of the sensors and compute their cross-correlation function. For instance, the correlation between the signals received at sensor i and k is:

$$R_{ik}(\tau)=\int x_i(t)x_k(t-\tau)dt, \tag{3}$$

The τ that maximizes the above correlation is the estimated time delay between the two signals. In practice, the above cross-correlation function can be computed more efficiently in the frequency domain as:

$$R_{ik}(\tau)=\int X_i(\omega)X_k^*(\omega)e^{j\omega\tau}d\omega, \tag{4}$$

where * represents complex conjugate. If Eq. (2) is plugged into Eq. (4), the reverberation term is ignored and the noise and source signal are assumed to be independent, the $\tau$ that maximizes the above correlation is $\tau_i-\tau_k$, which is the actual delay between the two sensors. When more than two sensors are considered, the sum over all possible pairs of sensors is taken to produce:

$$R(s) = \sum_{i=1}^{P}\sum_{k=1}^{P}\int X_i(\omega)X_k^*(\omega)e^{j\omega(\tau_i-\tau_k)}d\omega, \tag{5}$$

$$= \int\left[\sum_{i=1}^{P} X_i(\omega)e^{j\omega\tau_i}\right]\left[\sum_{k=1}^{P} X_k(\omega)e^{j\omega\tau_k}\right]^* d\omega,$$

$$= \int\left|\sum_{i=1}^{P} X_i(\omega)e^{j\omega\tau_i}\right|^2 d\omega, \tag{6}$$

The common practice is to maximize the above correlation through hypothesis testing, where s is the hypothesized source location, which determines the $\tau_i$'s on the right. Eq. (6) is also known as the steered response power (SRP) of the microphone array.

To address the reverberation and noise that may affect the SSL accuracy, it has been found that adding a weighting function in front of the correlation can greatly help. Eq. (5) is thus rewritten as:

$$R(s) = \sum_{i=1}^{P}\sum_{k=1}^{P}\int \Psi_{ik}(\omega)X_i(\omega)X_k^*(\omega)e^{j\omega(\tau_i-\tau_k)}d\omega, \tag{7}$$

A number of weighting functions have been tried. Among them, the heuristic-based PHAT weighting defined as:

$$\Psi_{ik}(\omega) = \frac{1}{|X_i(\omega)X_k^*(\omega)|} = \frac{1}{|X_i(\omega)||X_k(\omega)|} \tag{8}$$

has been found to perform very well under realistic acoustical conditions. Inserting Eq. (8) into Eq. (7), one gets:

$$R(s) = \int\left|\sum_{i=1}^{P}\frac{X_i(\omega)e^{j\omega\tau_i}}{|X_i(\omega)|}\right|^2 d\omega, \tag{9}$$

This algorithm is called SRP-PHAT. Note SRP-PHAT is very efficient to compute, because the number of weighting and summations drops from $P^2$ in Eq. (7) to P.

A more theoretically-sound weighting function is the maximum likelihood (ML) formulation, assuming high signal to noise ratio and no reverberation. The weighting function of a sensor pair is defined as:

$$\Psi_{ij}(\omega) = \frac{|X_i(\omega)||X_j(\omega)|}{|N_i(\omega)|^2|X_j(\omega)|^2 + |N_j(\omega)|^2|X_i(\omega)|^2}. \tag{10}$$

Eq. (10) can be inserted into Eq. (7) to obtain a ML based algorithm. This algorithm is known to be robust to environmental noise, but its performance in real-world applications is relatively poor, because reverberation is not modeled during its derivation. An improved version considers the reverberation explicitly. The reverberation is treated as another type of noise:

$$|N_i^c(\omega)|^2=\gamma|X_i(\omega)|^2+(1-\gamma)|N_i(\Omega)|^2, \tag{11}$$

where $N_i^c(\omega)$ is the combined noise or total noise. Eq. (11) is then plugged into Eq. (10) (replacing $N_i(\omega)$ with $N_i^c(\omega)$ to obtain the new weighting function. With some further approximation Eq. (11) becomes:

$$R(s) = \int\left|\sum_{i=1}^{P}\frac{X_i(\omega)e^{j\omega\tau_i}}{\gamma|X_i(\omega)| + (1-\gamma)|N_i(\omega)|}\right|^2 d\omega, \tag{12}$$

whose computational efficiency is close to SRP-PHAT.

2.2 The Present Technique

Note that algorithms derived from Eq. (10) are not true ML algorithms. This is because the optimal weight in Eq. (10) is derived for only two sensors. When more than 2 sensors are used, the adoption of Eq. (7) assumes that pairs of sensors are independent and their likelihood can be multiplied together, which is questionable. The present multi-sensor SSL technique is a true ML algorithm for the case of multiple audio sensors, as will be described next.

Figure 4A:
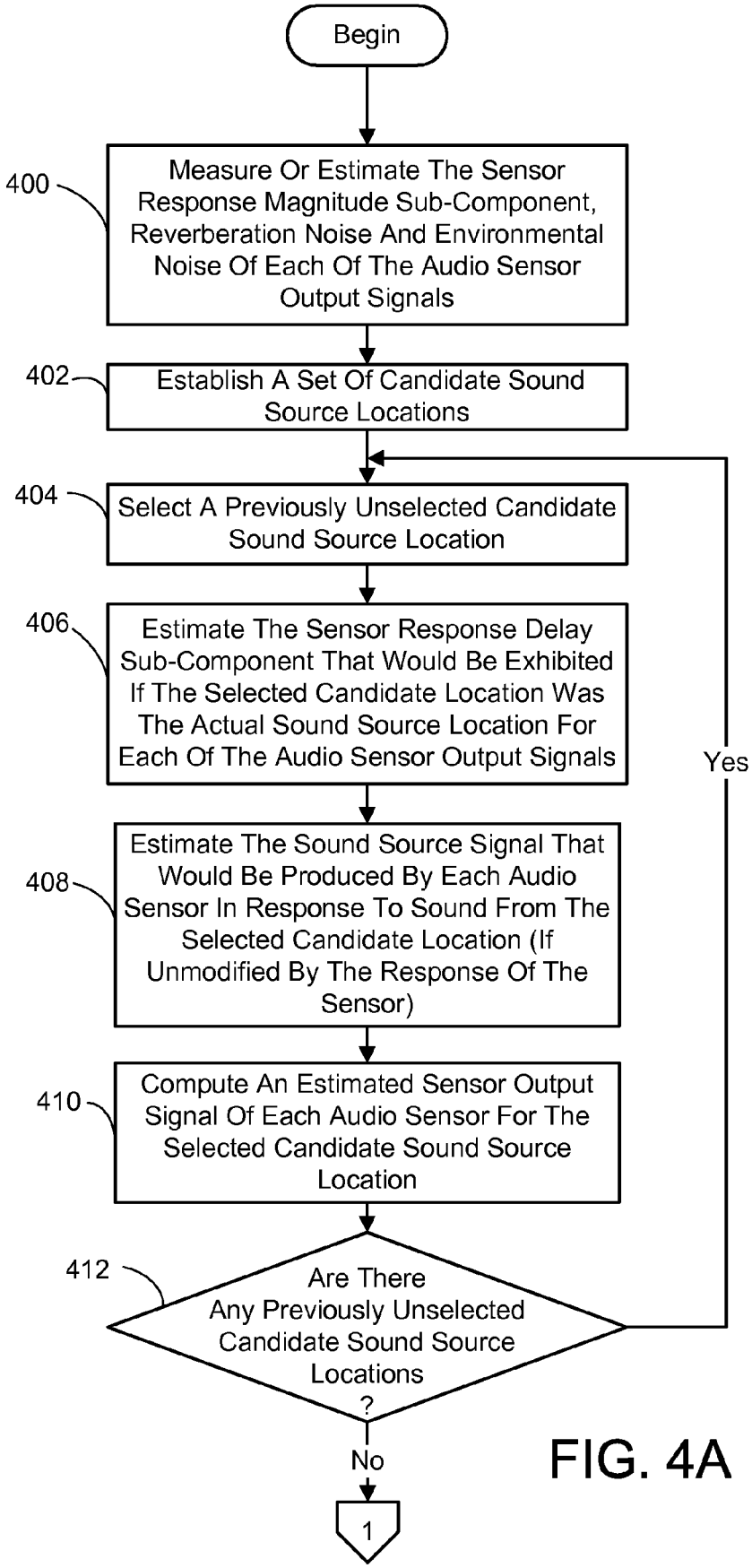
FIGS. 4A-B are a continuing flow diagram generally outlining an embodiment of a technique for implementing the multi-sensor sound source localization of FIG. 2.
Figure 4B:
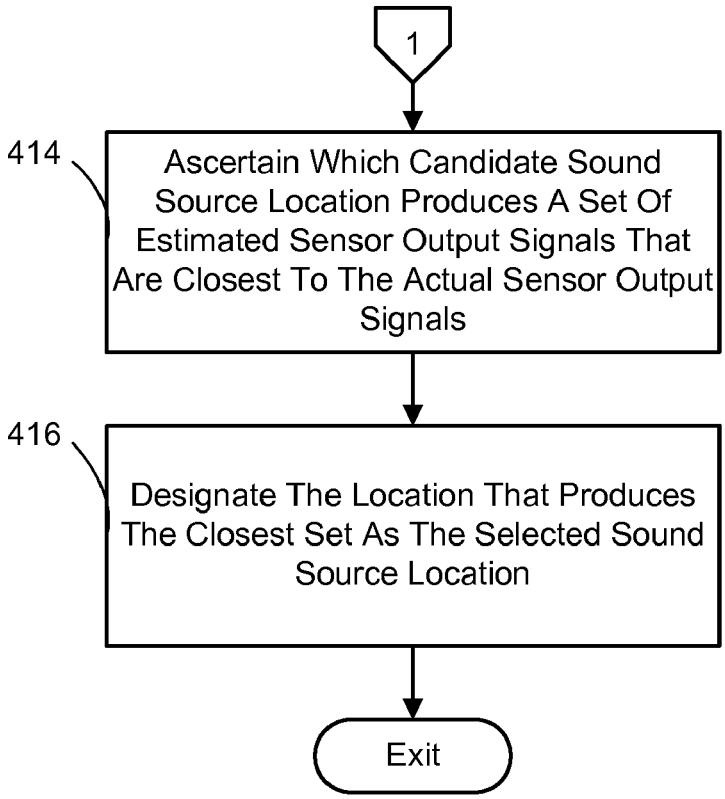

As stated previously, the present multi-sensor SSL involves selecting a sound source location that results in a time of propagation from the sound source to the audio sensors, which maximizes a likelihood of producing the inputted audio sensor output signals. One embodiment of a technique to implement this task is outlined in FIGS. 4A-B. The technique is based on a characterization of the signal output from each audio sensor in the microphone array as a combination of signal components. These components include a sound source signal produced by the audio sensor in response to sound emanating from the sound source, as modified by a sensor response which comprises a delay sub-component and a magnitude sub-component. In addition, there is a reverberation noise signal produced by the audio sensor in response to a reverberation of the sound emanating from the sound source. Further, there is an environmental noise signal produced by the audio sensor in response to environmental noise.

Given the foregoing characterization, the technique begins by measuring or estimating the sensor response magnitude sub-component, reverberation noise and environmental noise for each of the audio sensor output signals (400). In regard to the environmental noise, this can be estimated based on silence periods of the acoustical signals. These are portions of the sensor signal that do not contain signal components of the sound source and reverberation noise. In regard to the reverberation noise, this can be estimated as a prescribed proportion of the sensor output signal less the estimated environmental noise signal. The prescribed proportion is generally a percentage of the sensor output signal that is attributable to the reverberation of a sound typically experienced in the environment, and will depend on the circumstances of the environment. For example, the prescribed proportion is lower when the environment is sound absorbing and is lower when the sound source is anticipated to be located near the microphone array.

Next, a set of candidate sound source locations are established (402). Each of the candidate location represents a possible location of the sound source. This last task can be done in a variety of ways. For example, the locations can be chosen in a regular pattern surrounding the microphone array.

In one implementation this is accomplished by choosing points at regular intervals around each of a set of concentric circles of increasing radii lying in a plane defined by the audio sensors of the array. Another example of how the candidate locations can be established involves choosing locations in a region of the environment surrounding the array where it is known that the sound source is generally located. For instance, conventional methods for finding the direction of a sound source from a microphone array can be employed. Once a direction is determined, the candidate locations are chosen in the region of the environment in that general direction.

The technique continues with the selection of a previously unselected candidate sound source location (404). The sensor response delay sub-component that would be exhibited if the selected candidate location was the actual sound source location is then estimated for each of the audio sensor output signals (406). It is noted that the delay sub-component of an audio sensor is dependent on the time of propagation from the sound source to sensor, as will be described in greater detail later. Given this, and assuming a prior knowledge of the location of each audio sensor, the time of propagation of sound from each candidate sound source location to each of the audio sensors can be computed. It is this time of propagation that is used to estimate the sensor response delay sub-component.

Given the measurements or estimates for the sensor response sub-components, reverberation noise and environmental noise associated with each of the audio sensor output signals, the sound source signal that would be produced by each audio sensor in response to sound emanating from a sound source at the selected candidate location (if unmodified by the response of the sensor) is estimated (408) based on the previously described characterization of the audio sensor output signals. These measured and estimated components are then used to compute an estimated sensor output signal of each audio sensor for the selected candidate sound source location (410). This is again done using the foregoing signal characterization. It is next determined if there are any remaining unselected candidate sound source locations (412). If so, actions 404 through 412 are repeated until all the candidate locations have been considered and an estimated audio sensor output signal has been computed for each sensor and each candidate sound source location.

Once the estimated audio sensor output signals has been computed, it is next ascertained which candidate sound source location produces a set of estimated sensor output signals from the audio sensors that are closest to the actual sensor output signals of the sensors (414). The location that produces the closest set is designated as the aforementioned selected sound source location that maximizes the likelihood of producing the inputted audio sensor output signals (416).

In mathematical terms the foregoing technique can be described as follows. First, Eq. (2) is rewritten into a vector form:

$$X(\omega)=S(\omega)G(\omega)+S(\omega)H(\omega)+N(\omega), \tag{13}$$

where $$X(\omega)=[X_1(\omega),\ldots,X_P(\omega)]^T,$$

$$G(\omega)=[\alpha_1(\omega)e^{-j\omega\tau_1},\ldots,\alpha_P(\omega)e^{-j\omega\tau_P}]^T,$$

$$H(\omega)=[H_1(\omega),\ldots,H_P(\omega)]^T,$$

$$N(\omega)=[N_1(\omega),\ldots,N_P(\omega)]^T.$$

Among the variables, $X(\omega)$ represents the received signals and is known. $G(\omega)$ can be estimated or hypothesized during the SSL process, which will be detailed later. The reverberation term $S(\omega)H(\omega)$ is unknown, and will be treated as another type of noise.

To make the above model mathematically tractable, assume the combined total noise, $$N^c(\omega)=S(\omega)H(\omega)+N(\omega), \tag{14}$$

follows a zero-mean, independent between frequencies, joint Gaussian distribution, i.e., $$p(N^c(\omega))=\rho\exp\left\{-\frac{1}{2}[N^c(\omega)]^H Q^{-1}(\omega)N^c(\omega)\right\}, \tag{15}$$

where $\rho$ is a constant; superscript H represents the Hermitian transpose, and $Q(\omega)$ is the covariance matrix, which can be estimated by:

$$Q(\omega)=E\{N^c(\omega)[N^c(\omega)]^H\}=E\{N(\omega)N^H(\omega)\}+|S(\omega)|^2E\{H(\omega)H^H(\omega)\} \tag{16}$$

Here it is assumed the noise and the reverberation are uncorrelated. The first term in Eq. (16) can be directly estimated from the aforementioned silence periods of the acoustical signals:

$$E(N_i(\omega)N_j^*(\omega))=\lim_{K\to\infty}\frac{1}{K}\sum_{k=1}^{K}N_{ik}(\omega)N_{jk}^*(\omega), \tag{17}$$

where k is the index of audio frames that are silent. Note that the background noises received at different sensors may be correlated, such as the ones generated by computer fans in the room. If it is believed the noises are independent at different sensors, the first term of Eq. (16) can be simplified further as a diagonal matrix:

$$E\{N(\omega)N^H(\omega)\}=diag(E\{|N_1(\omega)|^2\},\ldots,E\{|N_P(\omega)|^2\}). \tag{18}$$

The second term in Eq. (16) is related to reverberation. It is generally unknown. As an approximation, assume it is a diagonal matrix:

$$|S(\omega)|^2E\{H(\omega)H^H(\omega)\}\approx\mathrm{diag}(\lambda_1,\ldots,\lambda_P), \tag{19}$$

with the $i^{th}$ diagonal element as:

$$\lambda_i=E\{|H_i(\omega)|^2|S(\omega)|^2\}\approx\gamma(|X_i(\omega)|^2-E\{|N_i(\omega)|^2\}) \tag{20}$$

where $0<\gamma<1$ is an empirical noise parameter. It is noted that in tested embodiments of the present technique, $\gamma$ was set to between about 0.1 and about 0.5 depending on the reverberation characteristics of the environment. It is also noted that Eq. (20) assumes the reverberation energy is a portion of the difference between the total received signal energy and the environmental noise energy. The same assumption was used in Eq. (11). Note again that Eq. (19) is an approximation, because normally the reverberation signals received at different sensors are correlated, and the matrix should have non-zero off-diagonal elements. Unfortunately, it is generally very difficult to estimate the actual reverberation signals or these off-diagonal elements in practice. In the following analysis, $Q(\omega)$ will be used to represent the noise covariance matrix, hence the derivation is applicable even when it does contain non-zero off-diagonal elements.

When the covariance matrix Q(ω) can be calculated or estimated from known signals, the likelihood of the received signals can be written as:

$$p(X|S, G, Q) = \prod_{\omega} p(X(\omega) \mid S(\omega), G(\omega), Q(\omega)), \tag{21}$$

where $$p(X(\omega)|S(\omega), G(\omega), Q(\omega)) = \rho\exp\left\{-\frac{J(\omega)}{2}\right\}, \tag{22}$$

and $$J(\omega) = [X(\omega) - S(\omega)G(\omega)]^H Q^{-1}(\omega)[X(\omega) - S(\omega)G(\omega)]. \tag{23}$$

The present SSL technique maximizes the above likelihood, given the observations X(ω), sensor response matrix G(ω) and noise covariance matrix Q(ω). Note the sensor response matrix G(ω) requires information about where the sound source comes from, hence the optimization is usually solved through hypothesis testing. That is, hypotheses are made about the sound source location, which gives G(ω). The likelihood is then measured. The hypothesis that results in the highest likelihood is determined to be the output of the SSL algorithm.

Instead of maximizing the likelihood in Eq. (21), the following negative log-likelihood can be minimized:

$$J = \int_{\omega} J(\omega)d\omega. \tag{24}$$

Since it is assumed the probabilities over the frequencies are independent to each other, each J(ω) can be minimized separately by varying the unknown variable S(ω). Given $Q^{-1}(\omega)$ is a Hermitian symmetric matrix, $Q^{-1}(\omega)=Q^{-H}(\omega)$, if the derivative of J(ω) is taken over S(ω), and set to zero, it produces:

$$\frac{\partial J(\omega)}{\partial S(\omega)} = -G(\omega)^T Q^{-T}(\omega)[X(\omega) - S(\omega)G(\omega)]^* = 0. \tag{25}$$

Therefore, $$S(\omega) = \frac{G^H(\omega)Q^{-1}(\omega)X(\omega)}{G^H(\omega)Q^{-1}(\omega)G(\omega)} \tag{26}$$

Next, insert the above S(ω) to J(ω):

$$J(\omega)=J_1(\omega)-J_2(\omega), \tag{27}$$

where $$J_1(\omega) = X^H(\omega)Q^{-1}(\omega)X(\omega) \tag{28}$$

$$J_2(\omega) = \frac{[G^H(\omega)Q^{-1}(\omega)X(\omega)]^H G^H(\omega)Q^{-1}(\omega)X(\omega)}{G^H(\omega)Q^{-1}(\omega)G(\omega)} \tag{29}$$

Note that $J_1(\omega)$ is not related to the hypothesized locations during hypothesis testing. Therefore, the present ML based SSL technique just maximizes:

$$J_2 = \int_{\omega} J_2(\omega)d\omega = \int_{\omega} \frac{[G^H(\omega)Q^{-1}(\omega)X(\omega)]^H G^H(\omega)Q^{-1}(\omega)X(\omega)}{G^H(\omega)Q^{-1}(\omega)G(\omega)}d\omega \tag{30}$$

Due to Eq. (26), $J_2$ can be rewritten as:

$$J_2 = \int_{\omega} \frac{|S(\omega)|^2}{[G^H(\omega)Q^{-1}(\omega)G(\omega)]^{-1}}d\omega. \tag{31}$$

The denominator $[G^H(\omega)Q^{-1}(\omega)G(\omega)]^{-1}$ can be shown as the residue noise power after MVDR beamforming. Hence this ML-based SSL is similar to having multiple MVDR beamformers perform beamforming along multiple hypothesis directions and picking the output direction as the one which results in the highest signal to noise ratio.

Next, assume that the noises in the sensors are independent, thus Q(ω) is a diagonal matrix:

$$Q(\omega)=\mathrm{diag}(\kappa_1, \ldots, \kappa_P), \tag{32}$$

with the $i^{th}$ diagonal element as:

$$\kappa_i = \lambda_i + E\{|N_i(\omega)|^2\} = \gamma|X_i(\omega)|^2 + (1-\gamma)E\{|N_i(\omega)|^2\} \tag{33}$$

Eq. (30) can thus be written as:

$$J_2 = \int_{\omega} \frac{1}{\sum_{i=1}^{P} \frac{|\alpha_i(\omega)|^2}{\kappa_i}} \left| \sum_{i=1}^{P} \frac{\alpha_i^*(\omega)}{\kappa_i} X_i(\omega)e^{j\omega\tau_i} \right|^2 d\omega \tag{34}$$

The sensor response factor $\alpha_i(\omega)$ can be accurately measured in some applications. For applications where it is unknown, it can be assumed it is a positive real number and estimate it as follows:

$$|\alpha_i(\omega)|^2|S(\omega)|^2 \approx |X_i(\omega)|^2 - \kappa_i, \tag{35}$$

where both sides represent the power of the signal received at sensor i without the combined noise (noise and reverberation). Therefore, $$\alpha_i(\omega) = \frac{\sqrt{(1-\gamma)(|X_i(\omega)|^2 - E\{|N_i(\omega)|^2\})}}{|S(\omega)|}, \tag{36}$$

Inserting Eq. (36) into Eq. (34) produces:

$$J_2 = \int_{\omega} \frac{\left| \sum_{i=1}^{P} \frac{1}{\kappa_i} \sqrt{|X_i(\omega)|^2 - E\{|N_i(\omega)|^2\}}\, X_i(\omega) e^{j\omega\tau_i} \right|^2}{\sum_{i=1}^{P} \frac{1}{\kappa_i} |X_i(\omega)|^2 - E\{|N_i(\omega)|^2} d\omega \tag{37}$$

It is noted that the present technique differs from the ML algorithm in Eq. (10) in the additional frequency-dependent weighting. It also has a more rigorous derivation and is a true ML technique for multiple sensors pairs.

Figure 5A:
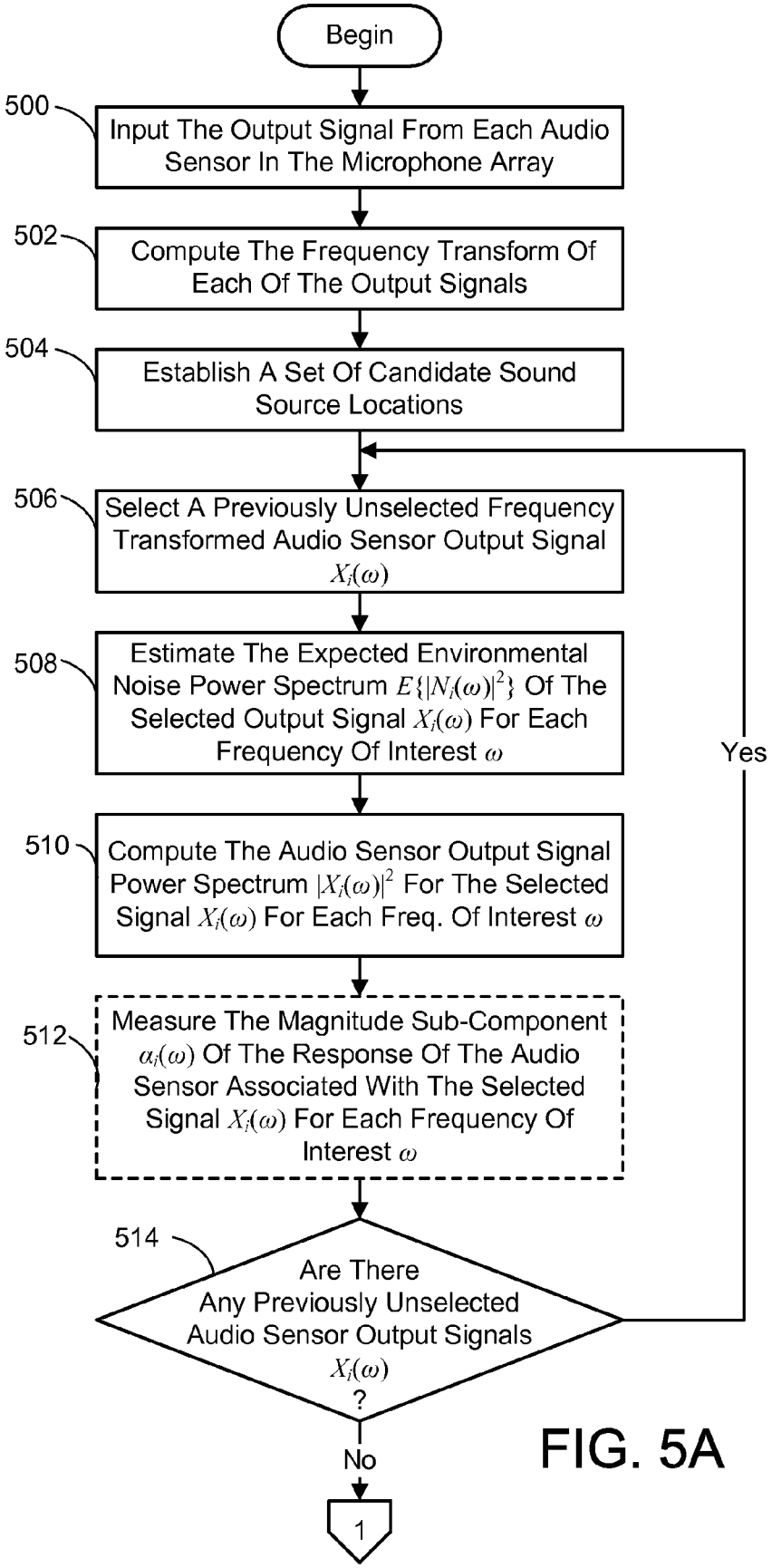
FIGS. 5A-B are a continuing flow diagram generally outlining a mathematical implementation of the multi-sensor sound source localization of FIGS. 4A-B.
Figure 5B:
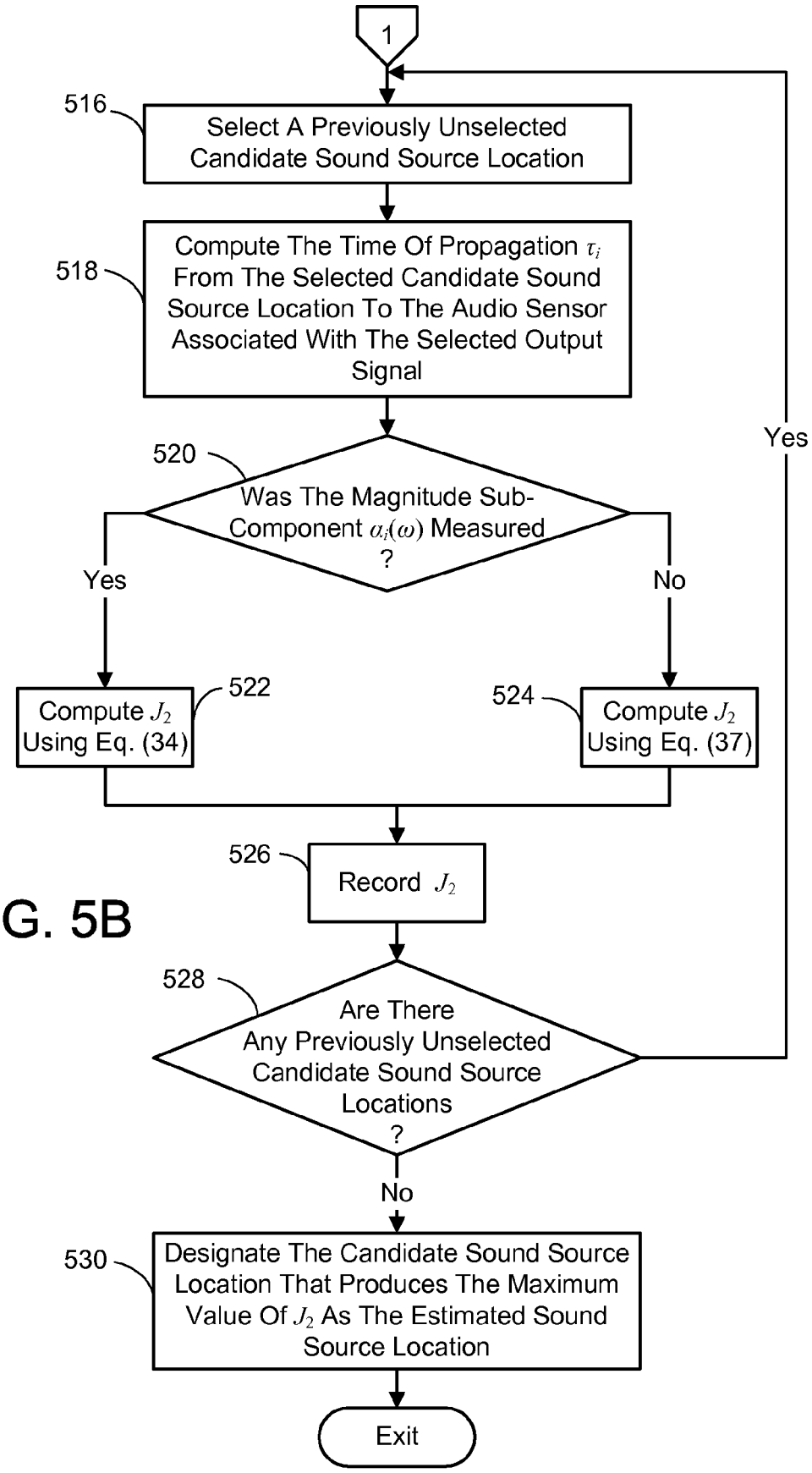

As indicated previously, the present technique involves ascertaining which candidate sound source location produces a set of estimated sensor output signals from the audio sensors that are closest to the actual sensor output signals. Eqs. (34) and (37) represent two of the ways the closest set can be found in the context of a maximization technique. FIGS. 5A-B shows one embodiment for implementing this maximization technique.

The technique begins with inputting the audio sensor output signal from each of the sensors in the microphone array (500) and computing the frequency transform of each of the signals (502). Any appropriate frequency transform can be employed for this purpose. In addition, the frequency transform can be limited to just those frequencies or frequency ranges that are known to be exhibited by the sound source. In this way, the processing cost is reduced as only frequencies of interest are handled. As in the previously described general procedure for estimating the SSL, a set of candidate sound source locations are established (504). Next, one of the previously unselected frequency transformed audio sensor output signals $X_i(\omega)$ is selected (506). The expected environmental noise power spectrum $E\{|N_i(\omega)|^2\}$ of the selected output signal $X_i(\omega)$ is estimated for each frequency of interest $\omega$ (508). In addition, the audio sensor output signal power spectrum $|X_i(\omega)|^2$ is computed for the selected signal $X_i(\omega)$ for each frequency of interest $\omega$ (510). Optionally, the magnitude sub-component $\alpha_i(\omega)$ of the response of the audio sensor associated with the selected signal $X_i(\omega)$ is measured for each frequency of interest $\omega$ (512). It is noted that the optional nature of this action is indicated by the dashed line box in FIG. 5A. It is then determined if there are any remaining unselected audio sensor output signals $X_i(\omega)$ (514). If so, actions (506) through (514) are repeated.

Referring now to FIG. 5B, if it is determined that there are no remaining unselected audio sensor output signals, a previously unselected one of the candidate sound source locations is selected (516). The time of propagation $\tau_i$ from the selected candidate sound source location to the audio sensor associated with the selected output signal is then computed (518). It is then determined if the magnitude sub-component $\alpha_i(\omega)$ was measured (520). If so, Eq. (34) is computed (522), and if not, Eq. (37) is computed (524). In either case, the resulting value for $J_2$ is recorded (526). It is then determined if there are any remaining candidate sound source locations that have not been selected (528). If there are remaining locations, actions (516) through (528) are repeated. If there are no locations left to select, then a value of $J_2$ has been computed at each candidate sound source location. Given this, the candidate sound source location that produces the maximum value of $J_2$ is designated as the estimated sound source location (530).

It is noted that in many practical applications of the foregoing technique, the signals output by the audio sensors of the microphone array will be digital signals. In that case, the frequencies of interest with regard to the audio sensor output signals, the expected environmental noise power spectrum of each signal, the audio sensor output signal power spectrum of each signal and the magnitude component of the audio sensor response associated with each signal are frequency bins as defined by the digital signal. Accordingly, Eqs. (34) and (37) are computed as a summation across all the frequency bins of interest rather than as an integral.

3.0 Other Embodiments

It should also be noted that any or all of the aforementioned embodiments throughout the description may be used in any combination desired to form additional hybrid embodiments. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

Wherefore, what is claimed is:

1. A computer-implemented process for estimating the location of a sound source using signals output by a microphone array having plural audio sensors placed so as to pick up sound emanating from the source in an environment exhibiting reverberation and environmental noise, comprising using a computer to perform the following process actions:

inputting the signal output by each of the audio sensors;

identifying a sound source location which if sound was emanated from that location would exhibit a time of propagation of the sound from the identified location to each audio sensor that would result in signals being output by the audio sensors that most closely match the actual signals currently being output by the audio sensors, using a maximum likelihood computation, wherein the maximum likelihood computation employs an estimate of an audio sensor response which comprises a delay sub-component and a magnitude sub-component for each of the audio sensors in computing the signal that would be output from each audio sensor if sound was emanated from the identified location; and designating the identified sound source location as the estimated sound source location.

2. The process of claim 1, wherein the process action of identifying a sound source location, comprises the actions of:

characterizing each sensor output signal as a combination of signal components comprising, a sound source signal produced by the audio sensor in response to sound emanating from the sound source as modified by said sensor response which comprises a delay sub-component and a magnitude sub-component, a reverberation noise signal produced by the audio sensor in response to a reverberation of the sound emanating from the sound source, and an environmental noise signal produced by the audio sensor in response to environmental noise;

measuring or estimating the sensor response magnitude sub-component, reverberation noise signal and environmental noise signal associated with each audio sensor;

estimating the sensor response delay sub-component for each of a prescribed set of candidate sound source locations for each of the audio sensors, wherein each candidate sound source location represents a possible location of the sound source;

computing an estimated sound source signal as it would be produced by each audio sensor in response to sound emanating from the sound source if unmodified by the sensor response of that sensor using the measured or estimated sensor response magnitude sub-component, reverberation noise signal, environmental noise signal, and sensor response delay sub-component associated with each audio sensor for each candidate sound source location;

computing an estimated sensor output signal for each audio sensor using the measured or estimated sound source signal, sensor response magnitude sub-component, reverberation noise signal, environmental noise signal, and sensor response delay sub-component associated with each audio sensor for each candidate sound source location;

comparing the estimated sensor output signal for each audio sensor to the corresponding actual sensor output signals and determining which candidate sound source location produces a set of estimated sensor output signals that are the closest to the actual sensor output signals for the audio sensors as a whole; and designating the candidate sound source location associated with the closest set of estimated sensor output signals as the selected sound source location.

3. The process of claim 2, wherein the process action of measuring or estimating the sensor response magnitude sub-component, reverberation noise signal and environmental noise signal associated with each audio sensor, comprises the actions of:

measuring the sensor output signal; and estimating the environmental noise signal based on portions of the measured sensor signal that do not contain signal components comprising the sound source signal and the reverberation noise signal.

4. The process of claim 3, wherein the process action of measuring or estimating the sensor response magnitude sub-component, reverberation noise signal and environmental noise signal associated with each audio sensor, comprises an action of estimating the reverberation noise signal as a prescribed proportion of the measured sensor output signal less the estimated environmental noise signal.

5. The process of claim 4, wherein the process action of estimating the reverberation noise signal as a prescribed proportion of the measured sensor output signal less the estimated environmental noise signal, comprises an action of establishing, prior to estimating the location of a sound source, the prescribed proportion as a percentage of reverberation of a sound typically experienced in the environment, such that the prescribed proportion is lower when the environment is sound absorbing.

6. The process of claim 4, wherein the process action of estimating the reverberation noise signal as a prescribed proportion of the measured sensor output signal less the estimated environmental noise signal, comprises an action of establishing, prior to estimating the location of a sound source, the prescribed proportion as a percentage of reverberation of a sound in the environment, such that the prescribed proportion is set lower the closer the sound source is anticipated to be located to the microphone array.

7. The process of claim 2, wherein the sensor response delay sub-component of an audio sensor is dependent on the time of propagation of sound emanating from the sound source to the audio sensor, and wherein the process action of estimating the sensor response delay sub-component for each of the prescribed set of candidate sound source locations for each of the audio sensors, comprises the actions of:

establishing, prior to estimating the location of a sound source, the set of candidate sound source locations;

establishing, prior to estimating the location of a sound source, the location of each audio sensor in relation to the candidate sound source locations;

for each audio sensor and each candidate sound source location, computing the time of propagation of sound emanating from the sound source to the audio sensor if the sound source were located at the candidate sound source location; and estimating the sensor response delay sub-component for each of the prescribed set of candidate sound source locations for each of the audio sensors using the computed time of propagation corresponding to each sensor and candidate location.

8. The process of claim 7, wherein the process action of establishing the set of candidate sound source locations, comprises an action of choosing locations in a regular pattern surrounding the microphone array.

9. The process of claim 8, wherein the process action of choosing locations in a regular pattern surrounding the microphone array, comprises the action of choosing points at regular intervals around each of a set of concentric circles of increasing radii lying in a plane defined by the plural audio sensors.

10. The process of claim 7, wherein the process action of establishing the set of candidate sound source locations, comprises an action of choosing locations in a region of the environment where it is known that the sound source is generally located.

11. The process of claim 7, wherein the process action of establishing the set of candidate sound source locations, comprises the actions of:

establishing a general direction from the microphone array where the sound source is located;

choosing locations in a region of the environment in said general direction.

12. The process of claim 2, wherein the measured or estimated sound source signal, sensor response magnitude sub-component, reverberation noise signal, environmental noise signal, and sensor response delay sub-component associated with each audio sensor for each candidate sound source location, are measured or estimated for a particular point in time, and wherein the process action of computing the estimated sensor output signal for each audio sensor for each candidate sound source location comprises an action of computing the estimated sensor output signals for said point in time, such that the selected sound source location is deemed the location of the sound source at said point in time.

13. The process of claim 2, wherein the process action of determining which candidate sound source location produces a set of estimated sensor output signals that are the closest to the actual sensor output signals for the audio sensors as a whole, comprises the actions of:

for each candidate sound source location, computing the equation $$\int_{\omega} \frac{1}{\sum_{i=1}^{P} \frac{|\alpha_i(\omega)|^2}{\gamma|X_i(\omega)|^2 + (1-\gamma)E\{|N_i(\omega)|^2\}}}$$

-continued $$\left|\sum_{i=1}^{P}\frac{\alpha_i^*(\omega)X_i(\omega)e^{j\omega\tau_i}}{\gamma|X_i(\omega)|^2+(1-\gamma)E\{|N_i(\omega)|^2\}}\right|^2 d\omega,$$

where ω denotes the frequency of interest, P is the total number of audio sensors i, $\alpha_i(\omega)$ is the magnitude sub-component of the audio sensor response, γ is a prescribed noise parameter, $|X_i(\omega)|^2$ is an audio sensor output signal power spectrum for the sensor signal $X_i(\omega)$, $E\{N_i(\omega)|^2\}$ is an expected environmental noise power spectrum of the signal $X_i(\omega)$, * denotes a complex conjugate and $\tau_i$ is a time of propagation of sound emanating from the sound source to the audio sensor i if the sound source were located at the candidate sound source location; and designating the candidate sound source location that maximizes the equation as the sound source location that produces a set of estimated sensor output signals that are the closest to the actual sensor output signals for the audio sensors as a whole.

14. The process of claim 2, wherein the process action of determining which candidate sound source location produces a set of estimated sensor output signals that are the closest to the actual sensor output signals for the audio sensors as a whole, comprises the actions of:

for each candidate sound source location, computing the equation $$\int_{\omega}\frac{1}{\sum_{i=1}^{P}\frac{|X_i(\omega)|^2-E\{|N_i(\omega)|^2\}}{\gamma|X_i(\omega)|^2+(1-\gamma)E\{|N_i(\omega)|^2\}}}\left|\sum_{i=1}^{P}\frac{\sqrt{|X_i(\omega)|^2-E\{|N_i(\omega)|^2\}}\,X_i(\omega)e^{j\omega\tau_i}}{\gamma|X_i(\omega)|^2+(1-\gamma)E\{|N_i(\omega)|^2\}}\right|^2 d\omega,$$

where ω denotes the frequency of interest, P is the total number of audio sensors i, γ is a prescribed noise parameter, $|X_i(\omega)|^2$ is an audio sensor output signal power spectrum for the sensor signal $X_i(\omega)$, $E\{|N_i(\omega)|^2\}$ is an expected environmental noise power spectrum of the signal $X_i(\omega)$ and $\tau_i$ is a time of propagation of sound emanating from the sound source to the audio sensor i if the sound source were located at the candidate sound source location; and designating the candidate sound source location that maximizes the equation as the sound source location that produces a set of estimated sensor output signals that are the closest to the actual sensor output signals for the audio sensors as a whole.

15. A system for estimating the location of a sound source in an environment exhibiting reverberation and environmental noise, comprising:

a microphone array having two or more audio sensors placed so as to pick up sound emanating from the sound source;

a general purpose computing device;

a computer program comprising program modules executable by the computing device, wherein the computing device is directed by the program modules of the computer program to, input a signal output by each of the audio sensors;

compute a frequency transform of each audio sensor output signal;

establish a set of candidate sound source locations, each of which represents a possible location of the sound source;

for each candidate sound source location and each audio sensor, compute the time of propagation $\tau_i$ from the candidate sound source location to the audio sensor, wherein i denotes which audio sensor;

for each frequency of interest of each frequency transformed audio sensor output signal, estimate an expected environmental noise power spectrum $E\{|N_i(\omega)|^2\}$ of the signal $X_i(\omega)$, wherein ω denotes which frequency of interest, and wherein the expected environmental noise power spectrum is the environmental noise power spectrum expected to be associated with the signal, compute an audio sensor output signal power spectrum $|X_i(\omega)|^2$ for the signal $X_i(\omega)$, measure a magnitude sub-component of an audio sensor response $\alpha_i(\omega)$ of the sensor associated with the signal $X_i(\omega)$;

for each candidate sound source location, compute the equation $$\int_{\omega}\frac{1}{\sum_{i=1}^{P}\frac{|\alpha_i(\omega)|^2}{\gamma|X_i(\omega)|^2+(1-\gamma)E\{|N_i(\omega)|^2\}}}\left|\sum_{i=1}^{P}\frac{\alpha_i^*(\omega)X_i(\omega)e^{j\omega\tau_i}}{\gamma|X_i(\omega)|^2+(1-\gamma)E\{|N_i(\omega)|^2\}}\right|^2 d\omega,$$

where P is the total number of audio sensors, * denotes a complex conjugate, and γ is a prescribed noise parameter; and designate the candidate sound source location that maximizes the equation as the estimated sound source location.

16. The system of claim 15, wherein the signals output by the microphone array are digital signals, and wherein the frequency of interest of each of the audio sensor output signals, the expected environmental noise power spectrum of each signal, the audio sensor output signal power spectrum of each signal and the magnitude component of the audio sensor response associated with the signal are frequency bins as defined by the digital signal, and wherein the equation is computed as a summation across all the frequency bins rather than as an integral across the frequencies.

17. The system of claim 15, wherein the program module for computing a frequency transform of each audio sensor output signal, comprises an sub-module for limiting the frequency transform to just those frequencies known to be exhibited by the sound source.

18. The system of claim 15, wherein the prescribed noise parameter γ is a value ranging between about 0.1 and about 0.5.

19. A system for estimating the location of a sound source in an environment exhibiting reverberation and environmental noise, comprising:

a microphone array having two or more audio sensors placed so as to pick up sound emanating from the sound source;

a general purpose computing device;

a computer program comprising program modules executable by the computing device, wherein the computing device is directed by the program modules of the computer program to, input a signal output by each of the audio sensors;

compute a frequency transform of each audio sensor output signal;

establish a set of candidate sound source locations, each of which represents a possible location of the sound source;

for each candidate sound source location and each audio sensor, compute the time of propagation $\tau_i$ from the candidate sound source location to the audio sensor, wherein i denotes which audio sensor;

for each frequency of interest of each frequency transformed audio sensor output signal, estimate an expected environmental noise power spectrum $E\{|N_i(\omega)|^2\}$ of the signal $X_i(\omega)$, wherein $\omega$ denotes which frequency of interest, and wherein the expected environmental noise power spectrum is the environmental noise power spectrum expected to be associated with the signal, compute an audio sensor output signal power spectrum $|X_i(\omega)|^2$ for the signal $X_i(\omega)$, for each candidate sound source location, compute the equation $$\int_{\omega} \frac{1}{\sum_{i=1}^{P} \frac{|X_i(\omega)|^2 - E\{|N_i(\omega)|^2\}}{\gamma|X_i(\omega)|^2 + (1-\gamma)E\{|N_i(\omega)|^2\}}} \left| \sum_{i=1}^{P} \frac{\sqrt{|X_i(\omega)|^2 - E\{|N_i(\omega)|^2\}}\, X_i(\omega) e^{j\omega\tau_i}}{\gamma|X_i(\omega)|^2 + (1-\gamma)E\{|N_i(\omega)|^2\}} \right|^2 d\omega,$$

where P is the total number of audio sensors and $\gamma$ is a prescribed noise parameter; and designate the candidate sound source location that maximizes the equation as the estimated sound source location.

20. The system of claim 19, wherein the signals output by the microphone array are digital signals, and wherein the frequency of interest of each of the audio sensor output signals, the expected environmental noise power spectrum of each signal and the audio sensor output signal power spectrum of each signal are frequency bins as defined by the digital signal, and wherein the equation is computed as a summation across all the frequency bins rather than as an integral across the frequencies.

* * * * *